United States Patent [19]

Grossman

[11] 4,054,994

[45] Oct. 25, 1977

[54] KNIFE AND BREAD BOARD ATTACHMENT

[76] Inventor: Milton J. Grossman, 10296 S. Mina, Whittier, Calif. 90605

[21] Appl. No.: 699,063

[22] Filed: June 23, 1976

[51] Int. Cl.[2] ..... B26B 11/00; A47G 21/14

[52] U.S. Cl. ..... 30/296 R; 83/646

[58] Field of Search ..... 30/124, 296 R, 114, 30/346; 83/607, 646, 647

[56] References Cited

U.S. PATENT DOCUMENTS

| | | | |
|---|---|---|---|
| 116,258 | 6/1871 | Bean | 83/607 |
| 1,274,551 | 8/1918 | Hoyt | 83/646 |
| 1,307,552 | 6/1919 | Johnson | 83/646 |
| 1,751,672 | 3/1930 | Westdahl | 83/647 |
| 1,998,383 | 4/1935 | Parodi | 83/607 |
| 2,333,736 | 11/1943 | Overbey | 30/346 |

*Primary Examiner*—Jimmy C. Peters
*Attorney, Agent, or Firm*—J. C. Baisch

[57] ABSTRACT

A knife and fixture for attaching the knife to an existing bread board, the front end of the knife being pivoted to the attachment so that the knife may be pivotly swung for chopping vegetables and the like, slicing tomatoes, meat and other foods, etc. The attachment is slipped on to an edge of the board and is resiliently held thereon by upper and lower arms at opposite sides of the board. The knife is sharpened or beveled on one side only. In another arrangement the knife is provided with a longitudinally extending slot at the forward end so that the knife may be guided and moved longitudinally for slicing food and the like.

11 Claims, 7 Drawing Figures

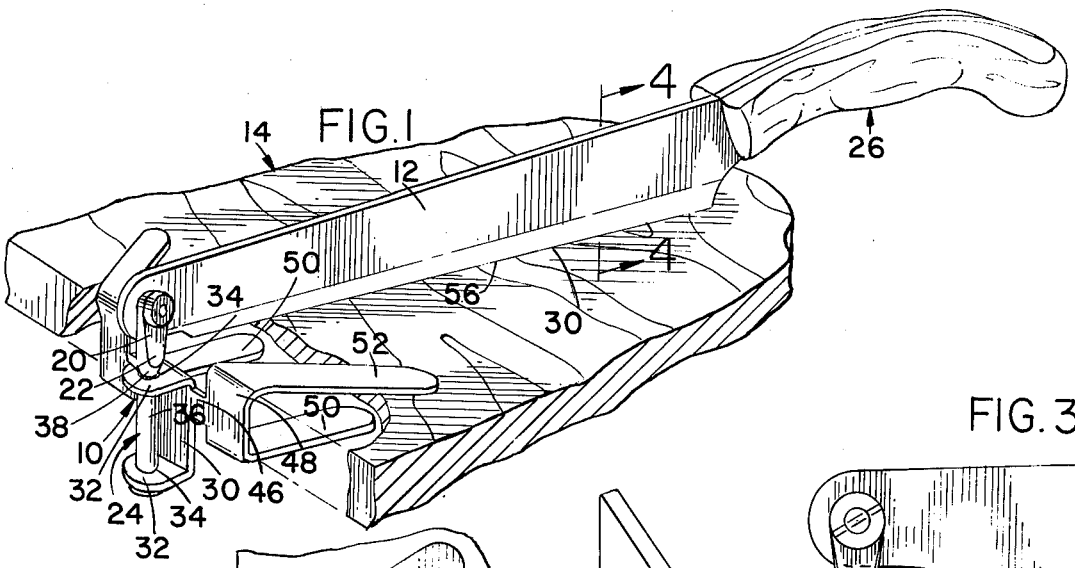
FIG. 1
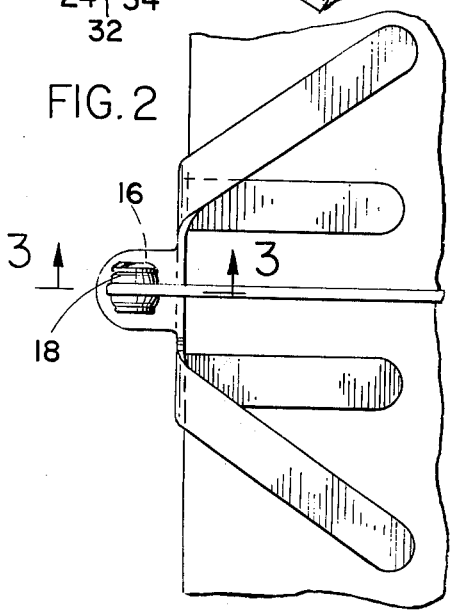
FIG. 2
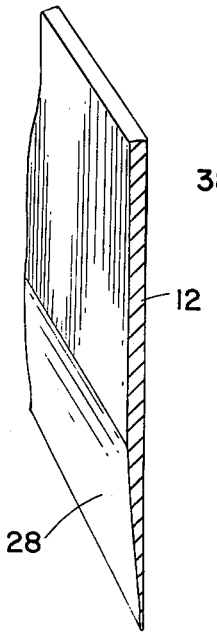
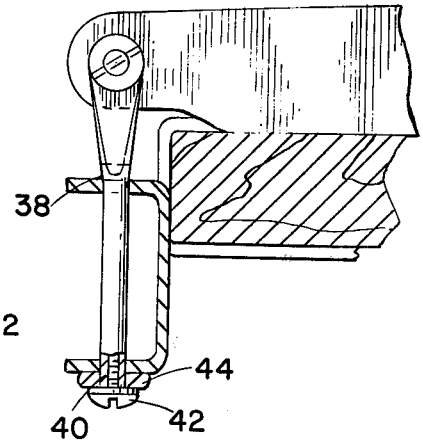
FIG. 3
FIG. 4
FIG. 6
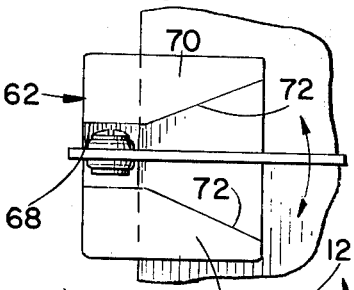
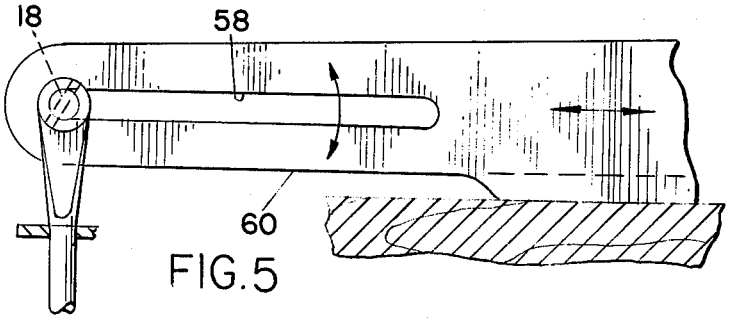
FIG. 5
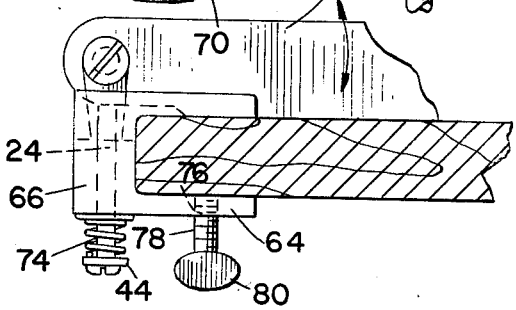
FIG. 7

KNIFE AND BREAD BOARD ATTACHMENT

BACKGROUND OF THE INVENTION

1. Field of the Invention. Invention

This invention relates generally to knives and means for operably attaching such knives to a bread board or the like for use in chopping or slicing food.

2. Description of the Prior Art

There are several types of blocks to which knives are attached for cutting such things as cheese; however, such apparatus is not satisfactory for chopping various other kinds of food such as vegetables, meats and etc. Further, such apparatus is generally permanently attached to a block.

SUMMARY OF THE INVENTION

In one embodiment of the invention there is a knife pivotly mounted at its front end to a clamp for quick and easy attachment to and removable from present bread boards with which most cabinets for kitchens are provided.

The attaching means is formed of a single piece of resilient sheet metal and includes a pair of ears extending forwardly from a body portion and provided with aligned openings therein for reception of a vertical pivot pin which pivots in said openings. The upper end of the pivot pin is provided with a yoke for aligned openings therein for reception of a horizontal pivot pin on which the forward end of a knife is pivoted. There are arms extending laterally from the body and from each of these arms there extends rearwardly a lower clamping arm and an upper clamping arm spaced upwardly of the lower clamping arm. The lower clamping arms extend rearwardly in parallel relationship with each other while the upper clamping arms diverge from the forward ends rearwardly and form wide V relative to each other. To attach the device, the upper and lower arms are slipped onto the edge of a bread board or other suitable board and resiliently clamped on to the board. By having the upper clamping arms to form a wide V, the knife may be operably activated in an arc without the cutting edge of th blade striking the clamping arms. The knife balde is beveled or sharpened only one one side, preferably on the right side, although it could be sharpened on the opposite side.

In another arrangement the knife blade is provided with a longitudinally extended slot at its forward end in which the horizontal pivot is disposed and the longitudinally extending lower edge portion is relieved so that the knife blade may be moved longitudinally during operation thereof without the lower edge of the knife striking the upper clamping arms should the knife be swung over such clamping arms.

Another arrangement of the device is secured to a board by means of a winged screw or the like and the forward end has a spring on the horizontal pivot that permits the forward end of the knife to move upwardly under certain operating conditions.

Basically, the clamping attachment or device has upper and lower clamping parts which in the device of FIGS. 1, 2, 3, and 5 comprise arms that are resilient while in the embodiment of FIGS. 6 and 7 comprise upper arms and a single lower part comprising a block, although there may also be more than one lower part.

OBJECTS AND ADVANTAGES OF THE INVENTION

It is an object of the invention to provide a knife and clamping means for easily and quickly attaching the knife to the edge of a board such as the well-known bread board.

Another object of the invention is to provide such a clamping device that is easily removed from the board when the apparatus is not in use.

Still another object of the invention is to provide a device of this character whereby the clamp and knife may be easily and quickly removed for cleaning and for storage.

A further object of the invention is to provide clamping means that may be resiliently clamped onto board.

A still further object of the invention is to provide a knife beveled or sharpened only on one side so that vegetables or the like chopped or cut with the knife are automatically pitched to one side when cut with this particular bevel thus causing no sticking to the blade when cutting.

Another object of the invention is to provide a clamp for upper and lower resilient arms for engagement with the top and bottom of the board to which the device is attached with the upper arms forming a wide V and the lower arms disposed for exerting pressure on the underside of the board in closer spaced relation relative to the upper arms.

Still another object of the invention is to provide means at the forward end of the knife blade whereby the knife may be moved longitudinally as well as pivotly.

A further object of the invention is to provide a relieved portion at the front end of the knife blade to prevent the blade from striking the upper clamping arms.

Another object of the invoice is to provide a clamp whereby the clamping means is secured to a board by means of a screw.

Still another object of the invoice is to provide resilient means on the vertical pivot of the clamp whereby the forward end of the knife may rise upwardly under certain operating conditions.

The characteristics and advantages of the invention are further sufficiently referred to in connection with the following detailed description of the accompanying drawings, which represent one embodiment. After considering this example, skilled persons will understand that many variations may be made without departing from the principles disclosed and I contemplate the employment of any structures, arrangements or modes of operation that are properly within the scope of the appended claims.

BRIEF DESCRIPTION OF THE DRAWINGS

Referring to the drawings which are for illustration purposes only:

FIG. 1 is a perspective view of the knife and clamp as attached to the edge of a supporting board;

FIG. 2 is a top plan view of the clamping apparatus of FIG. 1;

FIG. 3 is a partial side elevational view thereof;

FIG. 4 is a sectional view of the knife blade taken on line 4—4 of FIG. 1;

FIG. 5 is a fragmentary view of the forward and of an alternative knife attached to a horizontal pivot;

FIG. 6 is a top plan view of an alternative clamp arrangement; and

FIG. 7 is a fragmentary side elevational view of the knife attached to the clamp of FIG. 6.

DESCRIPTION OF THE PREFERRED EMBODIMENTS

Referring more particularly to FIGS. 1, 2 and 3, there is shown an attachment, indicated generally at 10, for releasably securing knife 12 to a bread board 14, of the usual type as shown, althoug it may be a block of another character.

The knife blade 12 is provided with a hole 16 adjacent to the forward end for reception of a horizontal pivot 18, whereby the knife is pivotly mounted between the arms 20 of a yoke, indicated generally at 22, at the upper end of a vertical pivot, indicated generally at 24, and which will be described more fully hereinafter.

Knife blade 12 is provided with a handle 26 at its free end, and said knife blade is beveled or sharpened at 28 on one side only along its lower edge. As shown, the knife is sharpened along the right hand side although it is to be understood that it could be sharpened on the opposite side.

The attachment 10 is formed of a single piece of sheet material that is resilient and includes a body 30 which extends vertically and a pair of forwardly turned ears 32 which are vertically spaced apart at the respective ends of the body portion. Ears 32 are provided with aligned holes 34 for reception of the stem 36 of the vertical pivot 24. There is a shoulder 38 at the junction of the yoke and stem 36 and said shoulder rests on the top side of the upper ear 32. The lower end of stem 36 is provided with a tapped bore which extends upwardly from the lower end of said stem for reception of a screw 40 and a head 42 of the usual character and there is a friction reducing washer 44 disposed between the screw head 42 and the lower side of the lower ear 32. Thus the vertical pivot 24 is operably mounted for stable operation so that there will be no wobble.

Extending laterally from the body 30 and in the same plane are connecting portions 46 which connect the body with walls 48 which are also in the same plane as the body and the connecting portions 46. From the lower ends of walls 48, there extends rearwardly extending parallel clamping arms 50 and from the upper ends of walls 48, there extends upper clamping arms 52 which diverge from each other and form a wide V. Upper clamping arms 52 extend outwardly beyond the lower clamping arms 50. The spacing apart of the planes of the lower clamping arms and the upper clamping arms is such as to readily receive a choppig board or block therebetween, the clamp being disposed on an edge of said board or block. When attached to the board, the planes respective of the lower clamping arms and the upper clamping arms converge sufficiently so that when the attachment is placed on the board there is resilient clamping of the board between the upper and lower clamping arms. The clamping attachment may be readily slipped onto the edge of the board and readily removed when use of the apparatus is not needed. When the clamping attachment is disposed on the edge of a board or block, the yoke 22 extends up beyond the plane of the top surface of said board or block. With the knife disposed on the horizontal pivot 18, the lower or sharpened edge 56 will rest throughout its length on the top surface of the board, so that when the knife is used to chop or cut vegetables or other foods, there will be a complete severence of the slices; and because the blade is sharpened only on one side, the slices will be automatically pitched to one side. When feeding vegetables or the like to be sliced, the vegetables are fed from the unsharpened side of the knife blade. It is noted that the knife blade is preferably sharpened on the right hand side.

By having the upper clamping arms diverging in a wide V, a substantial horizontal swinging of the knife is possible without the lower or cutting edge striking the upper clamping arms.

Referring to FIG. 5, there is shown an alternative arrangement of the blade. In this arrangement, there is a slot 58 which extends longitudinally in the forward end portion of the blade, said slot operably receiving at horizontal pivot 18. Thus longitudinal movement of the knife blade is provided which may be desirable for certain operations.

In the arrangement of FIG. 5, the knife blade has a relieved part 60 to clear the upper clamping arms.

Referring to FIGS. 6 and 7, there is shown an alternative clamp which is indicated generally at 62 and comprises a lower plate 64 with a wall 66 extending upwardly from the forward end of said plate. Wall 66 is notched at 68, said notch being open at its upper end from the opposite ends of the wall 66 and extends rearwardly a pair of arms 70 which are spaced apart horizontally and have their inner facing edges 72 diverging from their forward ends to form a V. The bottom of the notch 68 is below the arms 70 and there is a bore extending from the bottom of said notch to the underside of the wall 66 and a vertical pivot 24 is operably disposed in said bore. This vertical pivot arrangement is the same as that herein above described except that the stem is somewhat longer and there is a spring 74 disposed between the washer 44 and the bottom or underside of the wall 66. Thus, under certain conditions the forward end of the blade 12 may rise against the force of spring 74.

In order to clamp the device to a board, there is a tapped bore 76 for reception of a winged screw 78 which has a winged end 80 and turning said screw for attaching the device to the board or releasing the device from the board. To use the present apparatus, the clamping attachment is slipped on to an edge of a board, such as, a well-known bread board provided with various cabinets installed in kitchens. The resilient arms of the clamp securely holds the knife in operable position on the board end vegetables are fed to the knife from the unsharpened edge. At the same time, the knife is reciprocated and raised and lowered to cut slices from the vegetables or the like being sliced. Besides slicing the vegetables the sliced pieces can be arranged in a pile and chopped with the knife which may be swung on the vertical pivot during the chopping operation. Thus the vegetables or other food may be cut up as fine as desired.

After use, the apparatus may be slipped from the board for cleaning and storage.

In the alternative arrangement of FIGS. 6 and 7, the clamp is slipped on the edge of a board and secured by means of the winged screw 78. To remove the apparatus, it is only necessary to unscrew the wing screw 78 and slip the clamp from the board.

While the present invention is primarily for present bread boards and the like, it is to be understood that the term board as used herein includes other types of boards and chopping blocks.

The invention and its attendant advantages will be understood from the foregoing description and it will be apparent that various changes may be made in the form, construction and arrangement of the parts without departing from the spirit or scope thereof or sacrificing its material advantages, the arrangement herinbefore described being merely by way of example and I do not wish to be restricted to the specific form shown or uses mentioned except as defined in the accompanying claims.

I claim:

1. A knife and bread board attachment comprising:

a clamping device for attachment to a board, said clamping device having an upper and lower clamping means for receiving an edge portion of a board therebetween;

a knife having a blade; pivot means for pivotly connecting the forward end of the knife blade to said clamping device for vertical pivotal movements of said knife;

said means pivotly connecting the forward end of the knife blade to the clamping device is a horizontal pivot;

a vertical pivot for the clamping device carrying the horizontal pivot, whereby the knife blade may be swung horizontally as well as vertically;

and the upper parts of this clamping means comprises a pair of upper arms, the inner facing edges of said arms being laterally spaced apart and between which the lower sharpened edge of the knife may move into a position closely adjacent the surface of a board to which the device is attached.

2. A knife and bread board attachment comprising:

a clamping device for attachment to a board, said clamping device having an upper and lower clamping means for receiving an edge portion of a board therebetween;

a knife having a blade; pivot means for pivotly connecting the forward end of the knife blade to said clamping device for vertical pivotal movements of said knife;

said means pivotly connecting the forward end of the knife blade to the clamping device is a horizontal pivot;

a vertical pivot for the clamping device carrying the horizontal pivot, whereby the knife blade may be swung horizontally as well as vertically;

and the upper parts of this clamping means comprises a pair of upper arms, the inner facing edges of said arms diverging rearwardly from the forward end to form a wide V within which the lower sharpened edge of the knife may move into a position closely adjacent the surface of a board to which the device is attached.

3. The invention defined by claim 2 wherein said upper arms are resilient for resilient engagement with the top of a board to which the device is attached;

and the lower clamping means comprises a pair of lower arms for engagement with the underside of the board to cooperate with the upper arms for clampingly engaging the board.

4. The invention defined by claim 3 wherein the lower arms are resilient.

5. The invention defined by claim 4, wherein the clamping device is fored of sheet material and includes a vertical body;

a pair of vertically spaced forwardly turned ears having aligned openings therein;

the vertical pivot means being pivotly mounted in said openings;

a yoke carried by the vertical pivot means at the upper end thereof, the arms of said yoke having aligned openings therein for reception of the horizontal pivot on which the forward end of a knife blade is pivotly disposed between the arms of the yoke; connecting portions extending laterally from the body portion; walls at the outer ends of the connecting portions; the upper and lower clamping arms extending rearwardly from the upper and lower ends respectively of said walls.

6. The invention defined by claim 5, wherein the lower clamping arms are substantially parallel to each other and and spaced apart less distance than the outer free ends of the upper clamping arms.

7. The invention defined by claim 2, wherein said knife blade is sharpened on one side only with the sharp edge at the bottom.

8. The invention defined by claim 2, wherein a forward end portion of the knife blade is slotted for reception of the pivot means therein.

9. The invention defined by claim 2, wherein a lower edge portion at the front end of a knife blade is relieved.

10. The invention defined by claim 2, wherein the clamping device includes a plate for the underside of a board, and there is a screw for securing the clamping device to the board.

11. The invention defined by claim 10, including spring means for the vertical pivot for yieldingly holding the forward end of the knife blade in operative position.

* * * * *